US008960202B2

(12) United States Patent
Stewart

(10) Patent No.: US 8,960,202 B2
(45) **Date of Patent: *Feb. 24, 2015**

(54) HAIR CLIP APPARATUS AND METHOD

(71) Applicant: Connie Stewart, Scottsboro, AL (US)

(72) Inventor: Connie Stewart, Scottsboro, AL (US)

(73) Assignee: Rust Innovations, LLC, Scottsboro, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/059,136

(22) Filed: Oct. 21, 2013

(65) Prior Publication Data

US 2014/0048089 A1 Feb. 20, 2014

Related U.S. Application Data

(63) Continuation of application No. 13/422,334, filed on Mar. 16, 2012, now Pat. No. 8,590,544, and a continuation-in-part of application No. 12/694,687, filed on Jan. 27, 2010, now abandoned.

(60) Provisional application No. 61/239,605, filed on Sep. 3, 2009.

(51) Int. Cl.
*A45D 24/06* (2006.01)
*A45D 8/00* (2006.01)
(Continued)

(52) U.S. Cl.
CPC ... *A45D 8/12* (2013.01); *A45D 8/26* (2013.01); *A45D 8/28* (2013.01); *A45D 8/30* (2013.01); *A45D 2007/002* (2013.01); *A45D 2008/006* (2013.01)
USPC ..... 132/133; 132/135; 132/273; 132/275; 132/276; 132/278

(58) Field of Classification Search
CPC ..... A45D 8/12; A45D 8/14; A45D 8/16; A45D 8/20; A45D 8/22; A45D 8/28; A45D 8/30; A45D 8/34; A45D 8/36; A45D 8/26; A45D 2/42; A45D 24/04; A45D 2008/004; A45D 2008/006; A45D 2007/002
USPC ..... 132/135, 200, 207, 61, 63.1, 64.1, 65.1, 132/72.1, 212, 219, 106, 107, 120, 126, 132/127, 128, 130, 131, 132, 133, 134, 136, 132/138, 144, 145, 146, 153, 259, 273, 132/275–279, 148, 160, 163, 210, 129; 2/207, DIG. 11; 24/573.11, 578.12, 24/578.13, 578.14, 464, 465, 482, 515, 24/516, 541, 543, 544, 510, 487, 182, 478, 24/598.1, 616, 285, 24, 30.5 L, 589.1, 24/592.11, 17 B, 17 AP, 298, 301, 30.5 S, 24/308, 509; D28/21, 22, 27, 32–34, D28/39–43; 606/204.35
See application file for complete search history.

(56) References Cited

U.S. PATENT DOCUMENTS 169,578 A 11/1875 Poppenhusen
673,098 A 4/1901 Tissier
(Continued)

FOREIGN PATENT DOCUMENTS

NL 1001705 A1 9/1996

OTHER PUBLICATIONS

The New Bandette Comb, LOC-A-LOC, Inc., found at http://www.localoc.net/id55.html, printed on Aug. 5, 2009.

*Primary Examiner* — Vanitha Elgart
(74) *Attorney, Agent, or Firm* — Rahman LLC

(57) ABSTRACT

A hair apparatus and hair retention method includes a spine having a longitudinal axis, wherein the spine includes a hole and a peg outwardly protruding from an edge of the spine and substantially along the longitudinal axis of the spine. The spine includes a plurality of protrusions outwardly projecting orthogonal to the longitudinal axis of the spine. The hair apparatus further includes a first clip portion including a first connecting mechanism that non-integrally connects the first clip portion with the spine, wherein the first connecting mechanism is positioned at a first end of the first clip portion. The first clip portion includes a first attachment mechanism positioned at a second end of the first clip portion, wherein the first end is at an opposite end from the second end, and thereby the first connecting mechanism and the first attachment mechanism are positioned at opposite ends of the first clip portion.

20 Claims, 9 Drawing Sheets

(51) Int. Cl.

| | |
|---|---|
| ***A45D 8/12*** | (2006.01) |
| ***A45D 8/28*** | (2006.01) |
| ***A45D 8/30*** | (2006.01) |
| *A45D 8/26* | (2006.01) |
| *A45D 7/00* | (2006.01) |

(56) References Cited

U.S. PATENT DOCUMENTS

| | | | | |
|---|---|---|---|---|
| 694,934 | A | | 3/1902 | Machado |
| 794,479 | A | | 7/1905 | Austin |
| 840,681 | A | | 1/1907 | Becker |
| 849,766 | A | | 4/1907 | Baker |
| 902,317 | A | | 10/1908 | Nichols |
| 930,195 | A | | 8/1909 | Kohn |
| 941,586 | A | | 11/1909 | Purdy |
| 1,052,310 | A | | 2/1913 | Burlando |
| 1,182,242 | A | | 5/1916 | Bennett |
| 1,241,960 | A | | 10/1917 | Gould |
| 1,386,296 | A | | 8/1921 | Wessa |
| 1,533,380 | A | | 4/1925 | Burkhart |
| 1,640,429 | A | | 8/1927 | Speer |
| 1,795,598 | A | | 3/1931 | Fulton |
| 2,171,019 | A | | 8/1939 | Zupnyk |
| 2,361,772 | A | | 10/1944 | Kaplan |
| 2,428,985 | A | | 10/1947 | O'Neill |
| 2,454,642 | A | | 11/1948 | Finman |
| 2,496,487 | A | | 2/1950 | Moses |
| 2,509,658 | A | | 5/1950 | Wallace |
| 2,649,763 | A | | 8/1953 | Buergi-Schenk |
| 3,055,377 | A | | 9/1962 | Guinett et al. |
| 3,120,852 | A | | 2/1964 | Sawyer |
| 3,645,278 | A | | 2/1972 | Abraham |
| 4,522,215 | A | | 6/1985 | Verducci |
| 5,174,312 | A | | 12/1992 | Adams |
| 5,284,167 | A | | 2/1994 | Gill |
| 5,335,680 | A | | 8/1994 | Moore |
| 5,365,955 | A | | 11/1994 | Desgroux et al. |
| 5,398,705 | A | | 3/1995 | Hiltbrand et al. |
| 5,533,533 | A | | 7/1996 | Shing |
| 5,597,000 | A | | 1/1997 | Gerber |
| 5,634,480 | A | | 6/1997 | Lu |
| 5,666,982 | A | | 9/1997 | Pignon |
| 5,690,128 | A | | 11/1997 | Grimes |
| 5,694,956 | A | | 12/1997 | Grinszpan |
| 5,697,387 | A | | 12/1997 | Hanisco |
| 5,722,437 | A | | 3/1998 | Chang |
| 5,816,267 | A | | 10/1998 | Chou |
| 5,833,335 | A | | 11/1998 | Voughlohn |
| 5,890,497 | A | | 4/1999 | Tsai |
| 5,896,862 | A | | 4/1999 | Hwang |
| 6,035,499 | A | | 3/2000 | Ninomiya |
| 6,050,272 | A | | 4/2000 | Droin |
| 6,142,158 | A | | 11/2000 | Lloyd et al. |
| 6,186,151 | B1 | | 2/2001 | Newlin |
| 6,267,119 | B1 | | 7/2001 | Silva |
| 6,267,120 | B1 | | 7/2001 | Serignat |
| 6,439,242 | B1 | | 8/2002 | Head et al. |
| 6,578,585 | B1 | | 6/2003 | Stachowski et al. |
| 6,612,312 | B2 | | 9/2003 | Silva |
| 6,755,383 | B2 | | 6/2004 | Davis |
| D493,572 | S | | 7/2004 | Stachowski |
| D511,863 | S | | 11/2005 | Lau |
| 7,013,900 | B2 | | 3/2006 | Silva |
| D554,977 | S | | 11/2007 | Ravoy, Jr. |
| 7,373,940 | B1 | | 5/2008 | Lloyd |
| D590,994 | S | | 4/2009 | Hsu |
| D605,361 | S | | 12/2009 | Hsu |
| D605,814 | S | | 12/2009 | Hsu |
| D615,703 | S | | 5/2010 | Hsu |
| 7,766,020 | B2 | | 8/2010 | Chininis |
| D627,928 | S | | 11/2010 | Hsu |
| D667,167 | S | * | 9/2012 | Stewart ..... D28/42 |
| D667,997 | S | * | 9/2012 | Stewart ..... D28/42 |
| D671,265 | S | * | 11/2012 | Stewart ..... D28/42 |
| D671,266 | S | * | 11/2012 | Stewart ..... D28/42 |
| D671,683 | S | * | 11/2012 | Stewart ..... D28/42 |
| D674,136 | S | * | 1/2013 | Stewart ..... D28/42 |
| D674,542 | S | * | 1/2013 | Stewart ..... D28/42 |
| D674,543 | S | * | 1/2013 | Stewart ..... D28/42 |
| D674,544 | S | * | 1/2013 | Stewart ..... D28/42 |
| D683,073 | S | * | 5/2013 | Stewart ..... D28/42 |
| D690,879 | S | * | 10/2013 | Stewart ..... D28/42 |
| 2004/0103911 | A1 | | 6/2004 | Salvero |
| 2005/0199255 | A1 | | 9/2005 | Silva |
| 2007/0283976 | A1 | | 12/2007 | Adams |
| 2008/0127991 | A1 | | 6/2008 | Moreland |
| 2008/0216862 | A1 | | 9/2008 | Silva |
| 2008/0302382 | A1 | | 12/2008 | Wang |
| 2009/0229626 | A1 | * | 9/2009 | Hsu ..... 132/277 |

* cited by examiner

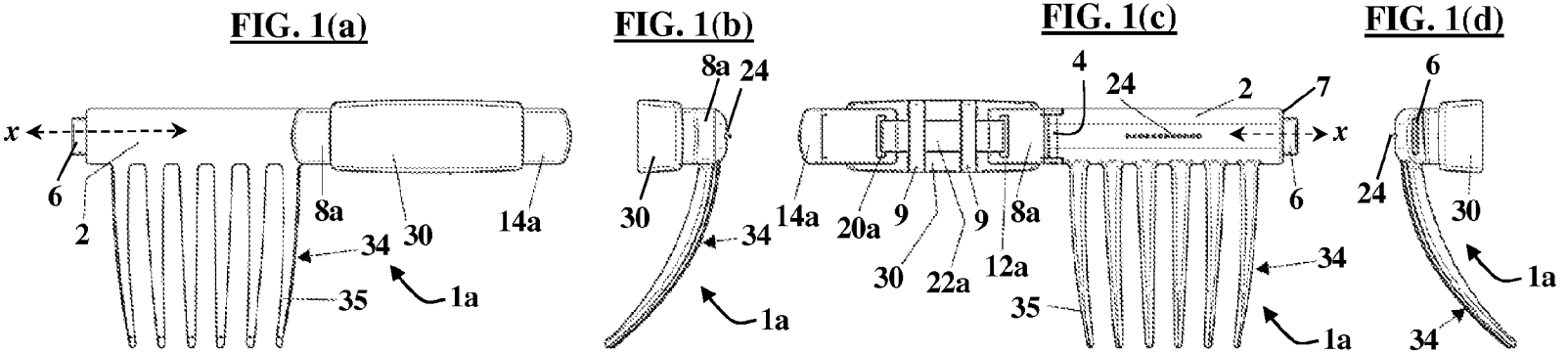
FIG. 1(a)
FIG. 1(b)
FIG. 1(c)
FIG. 1(d)
1a
2
4
6
7
8a
9
12a
14a
20a
22a
24
30
34
35
x
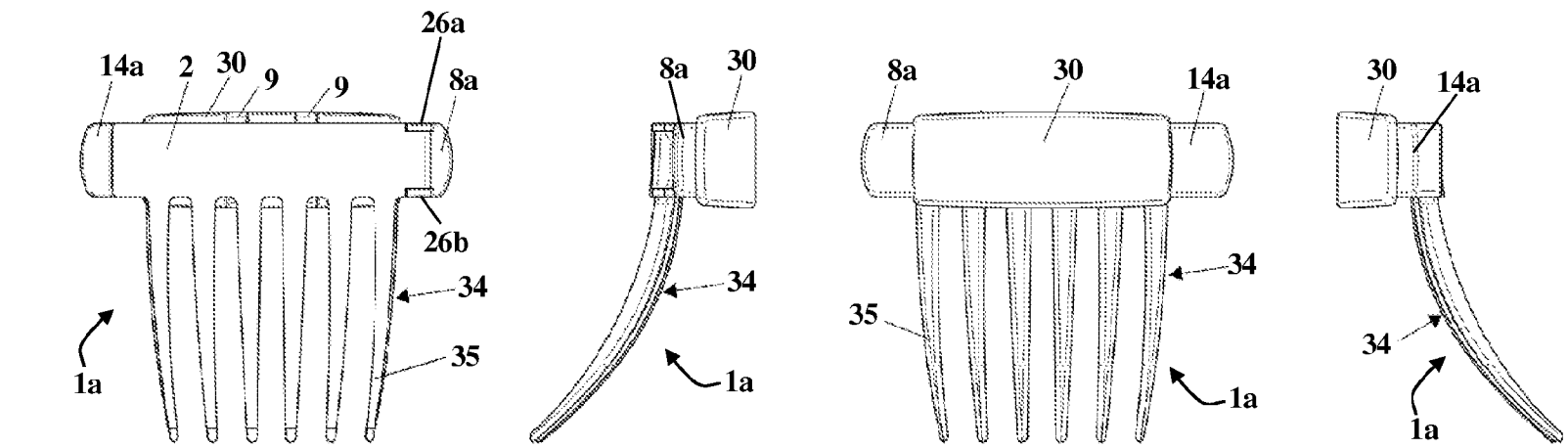
FIG. 2(a)
FIG. 2(b)
FIG. 2(c)
FIG. 2(d)
1a
2
8a
9
14a
26a
26b
30
34
35

1b
2
4
6
7
8a
9
12a
14a
16
20a
22a
24
26a
26b
28
30
32
x

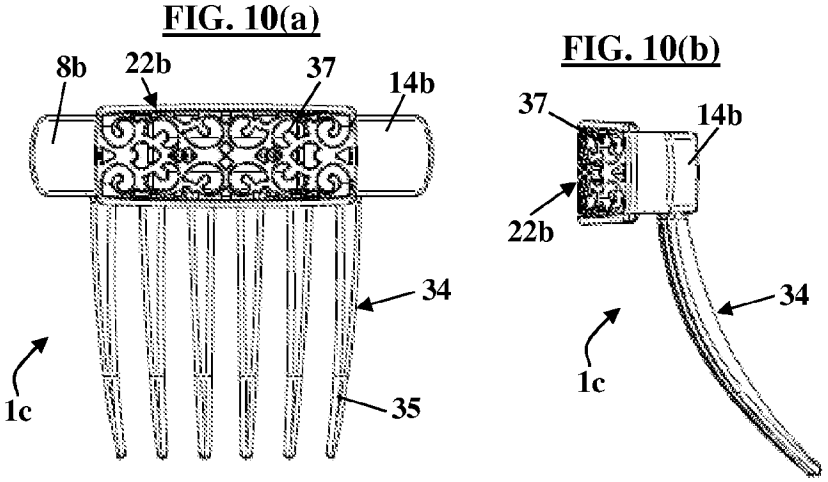
FIG. 10(a)
FIG. 10(b)
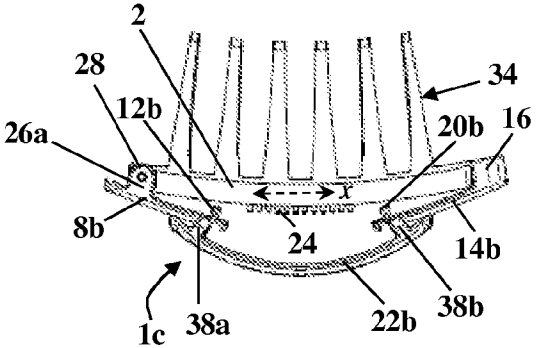
FIG. 10(c)
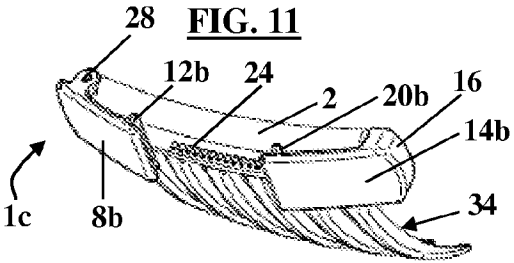
FIG. 11
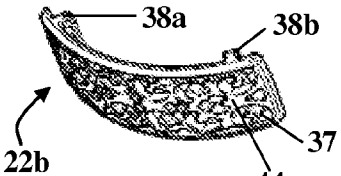
FIG. 12
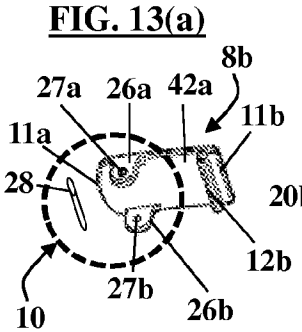
FIG. 13(a)
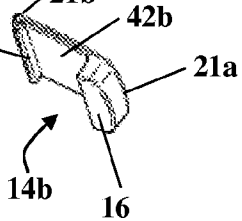
FIG. 13(b)

HAIR CLIP APPARATUS AND METHOD

CROSS-REFERENCE TO RELATED APPLICATIONS

This application is a continuation of U.S. patent application Ser. No. 13/422,334 filed on Mar. 16, 2012, which is a continuation-in-part of U.S. patent application Ser. No. 12/694,687 filed on Jan. 27, 2010, and which also claims priority to U.S. Provisional Patent Application Ser. No. 61/239,605 filed on Sep. 3, 2009, the complete disclosures of which, in their entireties, are herein incorporated by reference.

BACKGROUND

1. Technical Field

The embodiments herein generally relate to hair accessories, and, more particularly, to hair clips and methods of use.

2. Description of the Related Art

Hair combs are oftentimes used by individuals to secure their hair in a particular arrangement. Typically, a hair comb has a spine integral with a plurality of teeth. In use, the teeth are inserted into an individual's hair. The teeth of the comb grip the individual's hair to retain the hair and the comb in place. However, frequently, the teeth of the comb do not properly grip the individual's hair sufficiently to retain the hair in the desired arrangement.

Accordingly, it is desirable for a hair accessory device to provide adequate gripping and retention of the individual's hair and which is easy for the individual to use, particularly when the device is used on the back of the individual's head, and the individual has limited sight for properly setting the hair in the device.

SUMMARY

In view of the foregoing, an embodiment herein provides a hair apparatus comprising a spine comprising a longitudinal axis, wherein the spine comprises a hole and a peg outwardly protruding from an edge of the spine and substantially along the longitudinal axis of the spine. The spine comprises a plurality of protrusions outwardly projecting orthogonal to the longitudinal axis of the spine. The hair apparatus further includes a first clip portion comprising a first connecting mechanism that non-integrally connects the first clip portion with the spine, wherein the first connecting mechanism is positioned at a first end of the first clip portion. Additionally, the first clip portion comprises a first attachment mechanism positioned at a second end of the first clip portion, wherein the first end is at an opposite end from the second end, and thereby the first connecting mechanism and the first attachment mechanism are positioned at opposite ends of the first clip portion.

The hair apparatus also comprises a second clip portion comprising a second connecting mechanism comprising a catch that receives the peg of the spine, wherein the second connecting mechanism is positioned at a first end of the second clip portion. The catch comprises at least one stopper that engages the peg to prevent dislodgement of the peg once seated in the catch.

Moreover, the second clip portion also comprises a second attachment mechanism positioned at a second end of the second clip portion, wherein the first end is at an opposite end from the second end, and thereby the second connecting mechanism and the second attachment mechanism are positioned at opposite ends, respectively, of the second clip portion, respectively.

The hair apparatus further comprises a flexible member operatively connected to each of the first clip portion and the second clip portion. Furthermore, the first connecting mechanism comprises a pair of eye sockets that have holes, respectively that align with the hole of the spine. The hair apparatus further comprises a pin aligned and disposed through the hole of the spine and the holes of the pair of eye sockets of the first connecting mechanism of the first clip portion, wherein the pin causes the first connecting mechanism to rotate with respect to the spine.

The flexible member is stretchable, wherein an elasticity of the flexible member is mechanically structured to permit the second clip portion to engage the peg. Moreover, the elasticity of the flexible member is mechanically structured to pull and retain the second clip portion towards the spine upon the peg being seated in the catch.

In some embodiments, the hair apparatus further comprises a cover comprising at least one bar, wherein the flexible member is positioned through the at least one bar to operatively connect the cover to the flexible member. In one embodiment, the cover has a curved surface and tips that are positioned adjacent to the first clip portion and the second clip portion. In some embodiments, the hair apparatus further comprises a plurality of teeth coupled to the spine, wherein the teeth comprise a curved configuration.

In one embodiment, the flexible member comprises a first bar that engages the first attachment mechanism of the first clip portion. In one embodiment, the flexible member comprises a second bar that engages the second attachment mechanism of the second clip portion. The first attachment mechanism comprises a first aperture. The second attachment mechanism comprises a second aperture. The flexible member is positioned through each of the first aperture and the second aperture. The first clip portion comprises a first elongated section through which the aperture is configured. Additionally, the second clip portion comprises a second elongated section through which the aperture is configured.

Another embodiment provides a hair retention method comprising providing a hair apparatus comprising a spine comprising a peg outwardly protruding from an edge of the spine and substantially along a longitudinal axis of the spine; a first clip portion rotatably connecting the first clip portion with the spine; a second clip portion detachably connected to the spine; and a flexible member operatively connected to each of the first clip portion and the second clip portion. The method further comprises placing a portion of a user's hair on the spine; rotatably closing the first clip portion against the spine; and attaching the second clip portion to the spine, wherein the second clip portion comprises a catch that receives the peg of the spine, and wherein attachment of the second clip portion to the spine causes retention of the hair between the spine and the flexible member.

The flexible member is stretchable, wherein an elasticity of the flexible member is mechanically structured to permit the second clip portion to engage the peg, and wherein the elasticity of the flexible member is mechanically structured to pull and retain the second clip portion towards the spine upon the peg being seated in the second clip portion.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DESCRIPTION OF THE DRAWINGS

The embodiments herein will be better understood from the following detailed description with reference to the drawings, in which:

FIG. 1(*a*) is a rear perspective view of a hair apparatus in an open configuration according to an embodiment herein;

FIG. 1(*b*) is a left side perspective view of the hair apparatus of FIG. 1(*a*) in an open configuration according to an embodiment herein;

FIG. 1(*c*) is a front perspective view of the hair apparatus of FIG. 1(*a*) in an open configuration according to an embodiment herein;

FIG. 1(*d*) is a right side perspective view of the hair apparatus of FIG. 1(*a*) in an open configuration according to an embodiment herein;

FIG. 2(*b*) is a left side perspective view of the hair apparatus of FIG. 2(*a*) in a closed configuration according to an embodiment herein;

FIG. 2(*c*) is a front perspective view of the hair apparatus of FIG. 2(*a*) in a closed configuration according to an embodiment herein;

FIG. 2(*d*) is a right side perspective view of the hair apparatus of FIG. 2(*a*) in a closed configuration according to an embodiment herein;

FIG. 2(*e*) is a bottom perspective view of the hair apparatus of FIG. 2(*a*) in a closed configuration according to an embodiment herein;

FIG. 2(*f*) is an elevated perspective view of the hair apparatus of FIG. 2(*a*) in a closed configuration according to an embodiment herein;

FIG. 3(*b*) is a front perspective view of the hair apparatus of FIG. 2(*c*) in a closed configuration and without a cover according to an embodiment herein;

FIG. 4(*b*) is a top perspective view of the hair apparatus of FIG. 4(*a*) in an open configuration and without teeth according to an embodiment herein;

FIG. 4(*c*) is a front perspective view of the hair apparatus of FIG. 4(*a*) in an open configuration and without teeth according to an embodiment herein;

FIG. 4(*d*) is a right side perspective view of the hair apparatus of FIG. 4(*a*) in an open configuration and without teeth according to an embodiment herein;

FIG. 5(*b*) is a rear perspective view of the hair apparatus of FIG. 5(*a*) in a closed configuration and without teeth according to an embodiment herein;

FIG. 5(*c*) is a front perspective view of the hair apparatus of FIG. 5(*a*) in a closed configuration and without teeth according to an embodiment herein;

FIG. 6(*b*) is a front perspective view of the hair apparatus of FIG. 5(*c*) in a closed configuration and without a cover or teeth according to an embodiment herein;

FIG. 7(*b*) is a front view of the first clip portion of FIG. 7(*a*) according to an embodiment herein;

FIG. 8(*b*) is a side perspective view of the second clip portion of FIG. 8(*a*) according to an embodiment herein;

FIG. 8(*c*) is a front perspective view of the second clip portion of FIG. 8(*a*) according to an embodiment herein;

FIG. 8(*d*) is a top perspective view of the second clip portion of FIG. 8(*a*) according to an embodiment herein;

FIG. 8(*e*) is a front view of the second clip portion of FIG. 8(*a*) according to an embodiment herein;

FIG. 9(*b*) is a top perspective view of the cover of FIG. 9(*a*) according to an embodiment herein;

FIG. 9(*c*) is a front perspective view of the cover of FIG. 9(*a*) according to an embodiment herein;

FIG. 9(*d*) is a side perspective view of the cover of FIG. 9(*a*) according to an embodiment herein;

FIG. 10(*a*) is a front perspective view of a hair apparatus according to another embodiment herein;

FIG. 10(*b*) is a right side perspective view of the hair apparatus of FIG. 10(*a*) according to another embodiment herein;

FIG. 10(*c*) is a top perspective view of the hair apparatus of FIG. 10(*a*) according to another embodiment herein;

FIG. 11 is an elevated front perspective view of the hair apparatus of FIG. 9(*a*) without a flexible member according to another embodiment herein;

FIG. 12 is an elevated front perspective view of the flexible member of the hair apparatus of FIGS. 10(*a*) through 10(*c*) according to another embodiment herein;

FIG. 13(*a*) is a rear perspective view of the first clip of the hair apparatus of FIGS. 10(*a*) through 11 according to another embodiment herein;

FIG. 13(*b*) is a rear perspective view of the second clip of the hair apparatus of FIGS. 10(*a*) through 11 according to another embodiment herein.

DETAILED DESCRIPTION

Figure 2E:
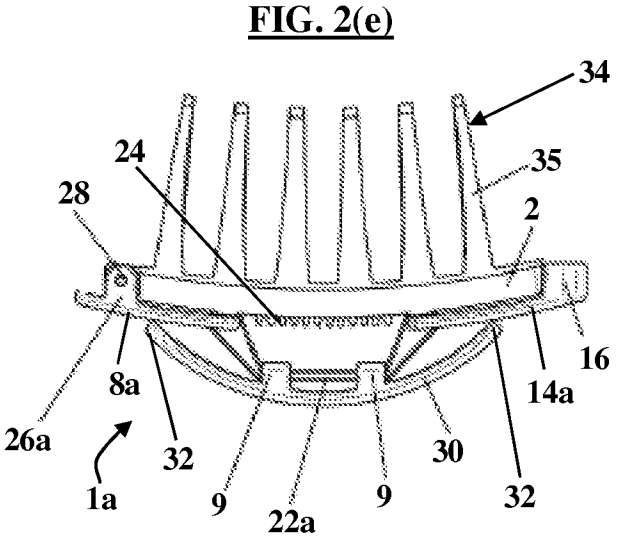
FIG. 2(*a*) is a rear perspective view of a hair apparatus in a closed configuration according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a hair clip apparatus and method that is easy to use and affords enhanced gripping of a user's hair. Referring now to the drawings, and more particularly to FIGS. 1(*a*) through 14, where similar reference characters denote corresponding features consistently throughout the figures, there are shown preferred embodiments.

Figure 2F:
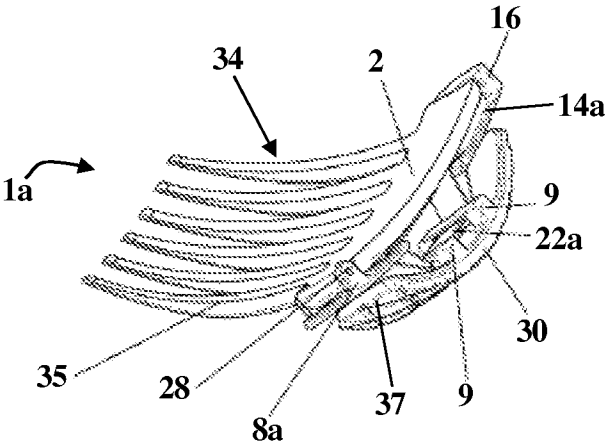
Figure 7A:
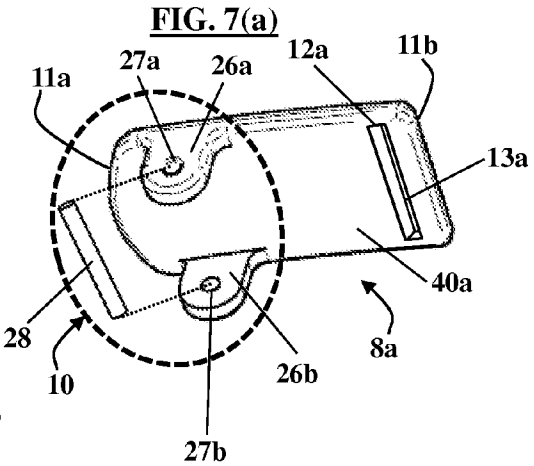
FIG. 7(*a*) is a rear perspective view of the first clip portion of the hair apparatus of FIGS. 1(*a*) through 6(*b*) according to an embodiment herein.
Figure 8E:
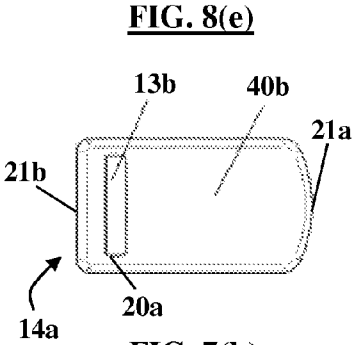
Figure 8D:
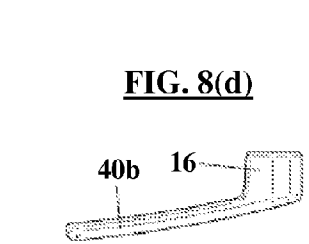
Figure 7B:
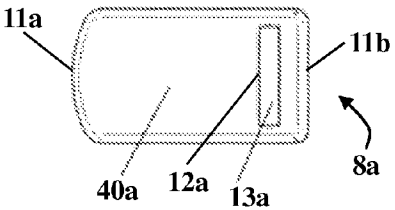
Figure 9A:
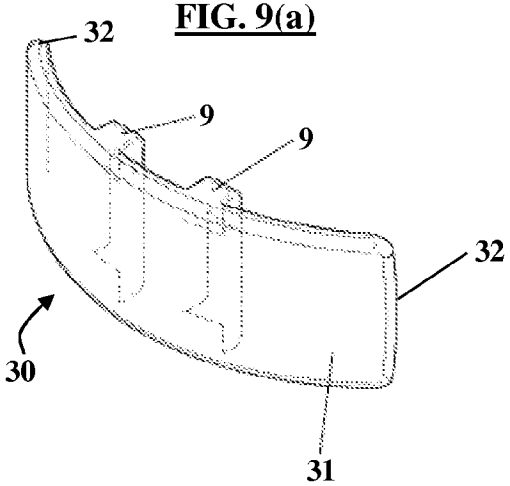
FIG. 9(*a*) is a perspective view of the cover of the hair apparatus of FIGS. 1(*a*) through 2(*f*) and 4(*a*) through 5(*c*) according to an embodiment herein.
Figure 9B:
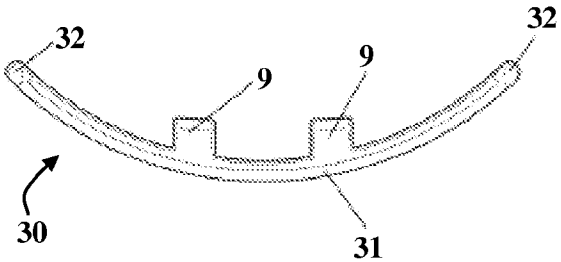
Figure 9C:
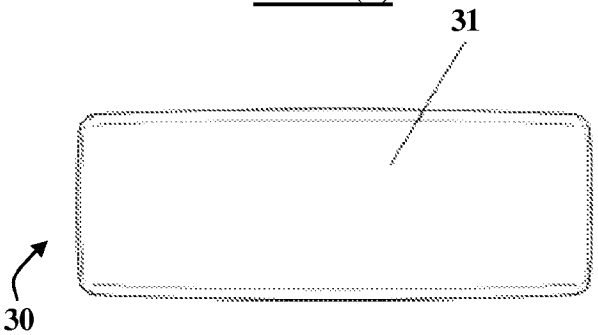
Figure 9D:
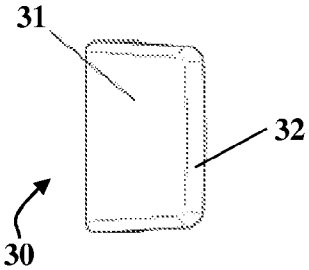

FIGS. 1(*a*) through 1(*d*) are various views of a hair apparatus in an open configuration according to an embodiment herein. FIGS. 2(*a*) through 2(*f*), with reference to FIGS. 1(*a*) through 1(*d*), are various views of a hair apparatus in a closed configuration according to an embodiment herein. In FIGS. 1(*a*) through 2(*f*), a hair apparatus 1*a* is depicted comprising a generally elongated spine 2 comprising a substantially longitudinal axis x. The spine 2 is slightly curvilinear or arc-shaped, therefore for the purposes of the descriptions of the embodiments herein, the longitudinal axis x is considered to follow the general curvilinearity of the spine 2. The spine 2 comprises a hole 4 (shown in phantom lines in FIG. 1(*c*)) and a peg 6 outwardly protruding from an edge 7 of the spine 2 and along the longitudinal axis x of the spine 2. The peg 6 may be substantially elongated in shape and have a thickness less than the thickness of the spine 2. The spine 2 comprises a plurality of protrusions 24 outwardly projecting orthogonal to the longitudinal axis x of the spine 2. In this regard, the protrusions 24 are aligned in a substantially linear manner (although following the general curvilinear shaped of the spine 2) along the spine 2 and project outward away from the spine 2 in a direction that is substantially perpendicular to the longitudinal axis x of the spine 2. The hair apparatus 1*a* further includes a first clip portion 8*a* comprising a first connecting mechanism 10 that non-integrally connects the first clip portion 8*a* with the spine 2. In FIG. 7(*a*), the first connecting mechanism 10 is depicted as the portion of the first clip portion 8*a* defined by the dashed encircled area.

Accordingly, the first connecting mechanism 10 comprises a pin 28 and a pair of eye sockets 26*a*, 26*b* that have holes 27*a*, 27*b*, respectively, that align with the hole 4 of the spine 2. The pin 28 is aligned and disposed through the hole 4 of the spine 2 and the holes 27*a*, 27*b* of the pair of eye sockets 26*a*, 26*b* of the first connecting mechanism 10, wherein the pin 28 causes the first connecting mechanism 10 to rotate with respect to the spine 2.

The first connecting mechanism 10 is positioned at a first end 11*a* (best shown in FIGS. 7(*a*) and 7(*b*)) of the first clip portion 8*a*. Additionally, the first clip portion 8*a* comprises a first attachment mechanism 12*a* positioned at a second end 11*b* (best shown in FIGS. 7(*a*) and 7(*b*)) of the first clip portion 8*a*, wherein the first end 11*a* (best shown in FIGS. 7(*a*) and 7(*b*)) is at an opposite end from the second end 11*b* (best shown in FIGS. 7(*a*) and 7(*b*)), and thereby the first connecting mechanism 10 and the first attachment mechanism 12*a* are positioned at opposite ends 11*a*, 11*b*, respectively, of the first clip portion 8*a* (best shown in FIGS. 7(*a*) and 7(*b*)).

The hair apparatus 1*a* also comprises a second clip portion 14*a* comprising a second connecting mechanism 16 comprising a catch 18 (best shown in FIGS. 8(*a*) and 8(*b*)) that receives the peg 6 of the spine 2, wherein the second connecting mechanism 16 is positioned at a first end 21*a* (best shown in FIG. 8(*e*)) of the second clip portion 14*a*. The catch 18 comprises at least one stopper 36 that engages the peg 6 to prevent dislodgement of the peg 6 once the peg 6 is seated in the catch 18.

Moreover, the second clip portion 14*a* also comprises a second attachment mechanism 20*a* positioned at a second end 21*b* (best shown in FIG. 8(*e*)) of the second clip portion 14*a*, wherein the first end 21*a* (best shown in FIG. 8(*e*)) is at an opposite end from the second end 21*b* (best shown in FIG. 8(*e*)), and thereby the second connecting mechanism 16 and the second attachment mechanism 20*a* are positioned at opposite ends 21*a*, 21*b*, respectively, of the second clip portion 14*a*, respectively (best shown in FIG. 8(*e*)).

The hair apparatus 1*a* further comprises a flexible member 22*a* operatively connected to each of the first clip portion 8*a* and the second clip portion 14*a*. The flexible member 22*a* is stretchable and may be embodied as an elastic band, wherein the elasticity of the flexible member 22*a* is mechanically structured to permit the second clip portion 14*a* to engage the peg 6. Moreover, the elasticity of the flexible member 22*a* is mechanically structured to pull and retain the second clip portion 14*a* towards the spine 2 upon the peg 6 being seated in the catch 18.

The hair apparatus 1*a* further comprises a cover 30, as further shown in FIGS. 9(*a*) through 9(*d*), which comprises at least one bar 9, wherein the flexible member 22*a* is positioned through the at least one bar 9 to operatively connect the cover 30 to the flexible member 22*a*. In one embodiment, the cover 30 has a curved surface 31 and tips 32 that are positioned adjacent to the first clip portion 8*a* and the second clip portion 14*a*. In one embodiment, the cover 30 may comprise decorative features 37 (as shown in FIG. 2(*f*)) including markings, designs, or can be colored differently than the other parts of the hair apparatus 1*a*. The cover 30 may be flexible and accordingly, the tips 32 may slide across the first clip portion 8*a* and the second clip portion 14*a* when the cover 30 is pressed towards the spine 2. The flexible member 22 pulls the cover 30 towards the spine 2 through the elastic properties of the flexible member 22, which helps retain the cover 30 in proper position. The hair apparatus 1*a* further comprises a plurality of teeth 34 coupled to the spine 2, wherein the teeth 34 comprise a curved and tapered configuration 35 to facilitate proper seating in the user's hair (not shown) and to prevent unintended discharge of the hair apparatus 1*a* once positioned in the user's hair (not shown). The teeth 34 are integrally formed with the spine 2 to create a single fixed structure of the teeth 24 and spine 2.

The first attachment mechanism 12*a* comprises a first aperture 13*a* (best shown in FIGS. 7(*a*) and 7(*b*)). The second attachment mechanism 20*a* comprises a second aperture 13*b* (best shown in FIGS. 8(*c*) and 8(*e*)). The flexible member 22*a* is positioned through each of the first aperture 13*a* and the second aperture 13*b*. The first clip portion 8*a* comprises a first elongated section 40*a* (best shown in FIGS. 7(*a*) and 7(*b*)) through which the aperture 13*a* is configured. Additionally, the second clip portion 14*a* comprises a second elongated section 40*b* (best shown in FIGS. 8(*a*) through 8(*e*)) through which the aperture 13*b* is configured.

When in operation, the teeth 34 are inserted in the user's hair (not shown) and then a portion of the user's hair (not shown) is gathered and placed on the spine 2 and substantially over the plurality of protrusions 24 when the hair apparatus 1*a* is in an open configuration as in FIGS. 1(*a*) through 1(*d*). Next, the first clip portion 8*a* is rotatably closed as indicated in FIGS. 2(*a*) through 2(*f*) to compress the gathered hair (not shown) between the spine 2 and the back of the flexible member 22*a*, cover 30, at least one bar 9, and potentially a portion of the back of the first clip portion 8*a*. Then, the second clip portion 14*a* is pulled over the peg 6 with the flexible member 22*a* providing resistance to the attached second clip portion 14*a* to prevent the second clip portion 14*a* from loosely detaching from the hair apparatus 1*a*. Once the peg 6 is seated in the catch 18 of the second clip portion 14*a*, the flexible member 22*a* continues to provide resistance to the second clip portion 14*a* to prevent the second clip portion 14*a* from releasing the peg 6 and detaching from the spine 2. Additionally, as described above, the at least one stopper 36 also engages the peg 6 to prevent dislodgement of the peg 6 once the peg 6 is seated in the catch 18.

Figure 3A:
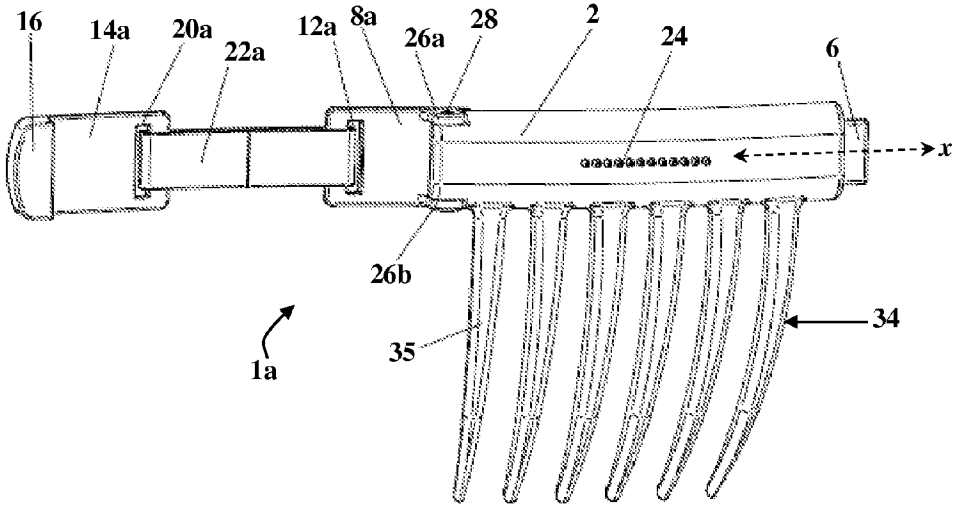
FIG. 3(*a*) is a front perspective view of the hair apparatus of FIG. 1(*c*) in an open configuration and without a cover according to an embodiment herein.
Figure 3B:
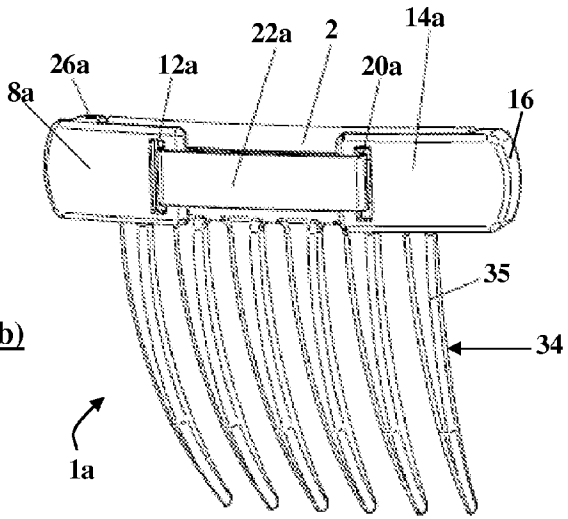

FIG. 3(*a*), with reference to FIGS. 1(*a*) through 2(*f*), is a front perspective view of the hair apparatus 1*a* of FIG. 1(*c*) in an open configuration and without the cover 30 according to an embodiment herein. FIG. 3(*b*), with reference to FIGS. 1(*a*) through 3(*b*), is a front perspective view of the hair apparatus 1*a* of FIG. 2(*c*) in a closed configuration and without the cover 30 of the embodiments shown in FIGS. 1(*a*) through 2(*f*) according to an embodiment herein. These views illustrate the general configuration of the flexible member 22*a* in greater detail. As shown, the flexible member 22*a* may be configured as a generally rectangular band, although other shapes are possible, and the embodiments herein are not restricted to a particular configuration or geometry of the flexible member 22*a*. The flexible member 22*a* may comprise a single band or multiple bands fastened to one another (e.g., woven, sewn, stitched, etc.). The hair apparatus 1*a* may be configured without the cover 30 accordingly as indicated in FIGS. 3(*a*) and 3(*b*) and its method of operation is similar to the operation described above with reference to the embodiment shown with the cover 30 (e.g., FIGS. 1(*a*) through 2(*f*)).

Figures 4A, 4B, 4C, 4D, 5A, 5B, 5C:
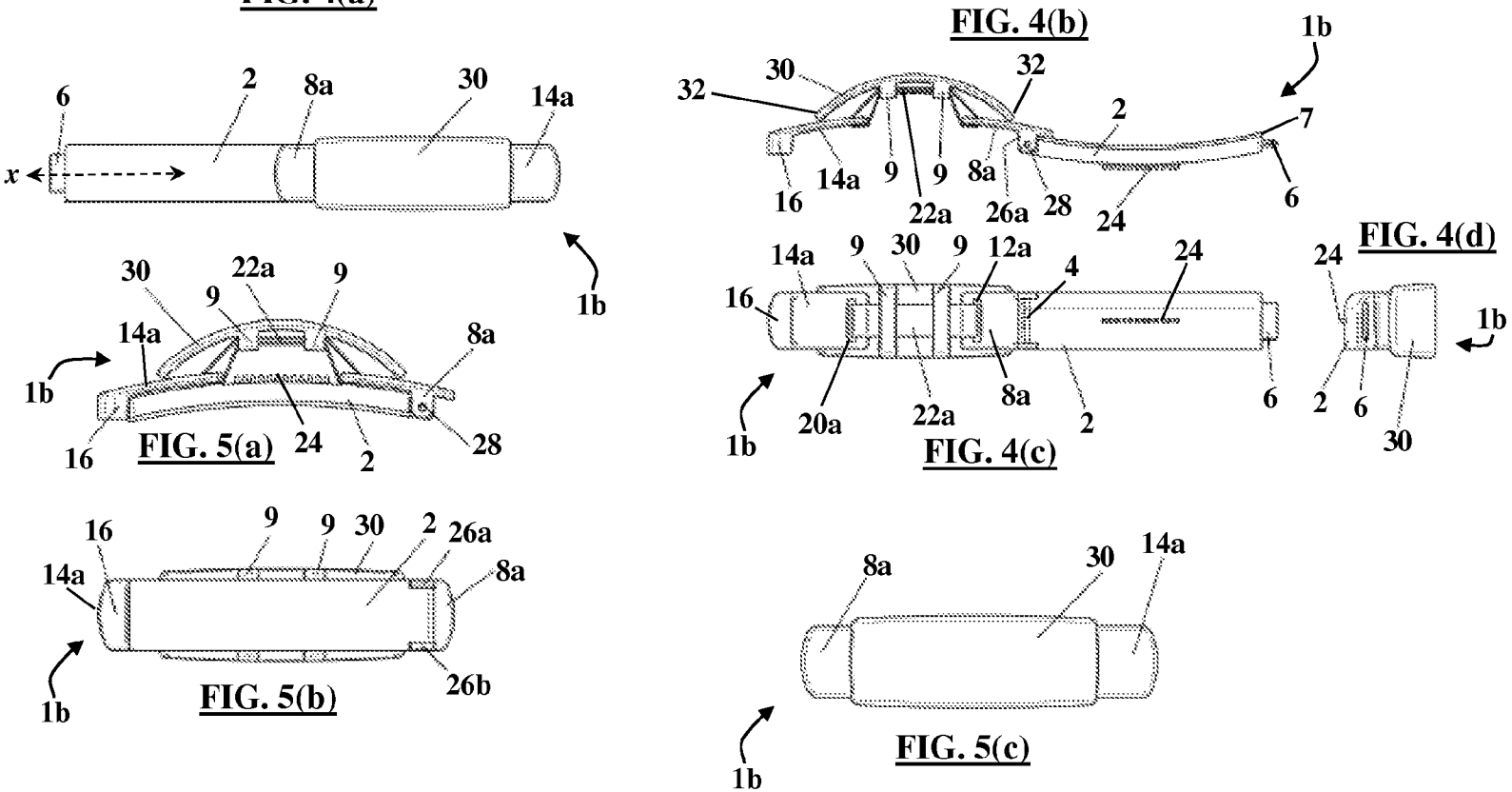
FIG. 4(*a*) is a rear perspective view of a hair apparatus in an open configuration and without teeth according to an embodiment herein.
FIG. 5(*a*) is a top perspective view of a hair apparatus in a closed configuration and without teeth according to an embodiment herein.

FIGS. 4(*a*) through 4(*d*), with reference to FIGS. 1(*a*) through 3(*b*), are various views of a hair apparatus 1*b* in an open configuration and without the teeth 34 of the embodiments shown in FIGS. 1(*a*) through 3(*b*) according to an embodiment herein. FIGS. 5(*a*) through 5(*c*), with reference to FIGS. 1(*a*) through 4(*d*), are various views of the hair apparatus 1*b* (of FIGS. 4(*a*) through 4(*d*)) in a closed configuration and without the teeth 34 of the embodiments shown in FIGS. 1(*a*) through 3(*b*) according to an embodiment herein. The structure and operation of the hair apparatus 1*b* is similar as that described above with respect to hair apparatus 1*a* except there is no teeth 34, and accordingly the hair apparatus 1*b* tends to "float" with the user's hair (not shown) as opposed to being snugly dug into the user's hair (not shown) due to the absence of the teeth 34. However, the gathered portion of the user's hair (not shown) is similarly inserted against the spine 2 and is compressed by the closing of the first clip portion 8*a* and attachment of the second clip portion 14*a* as described above with reference to hair apparatus 1*a*.

Figure 6A:
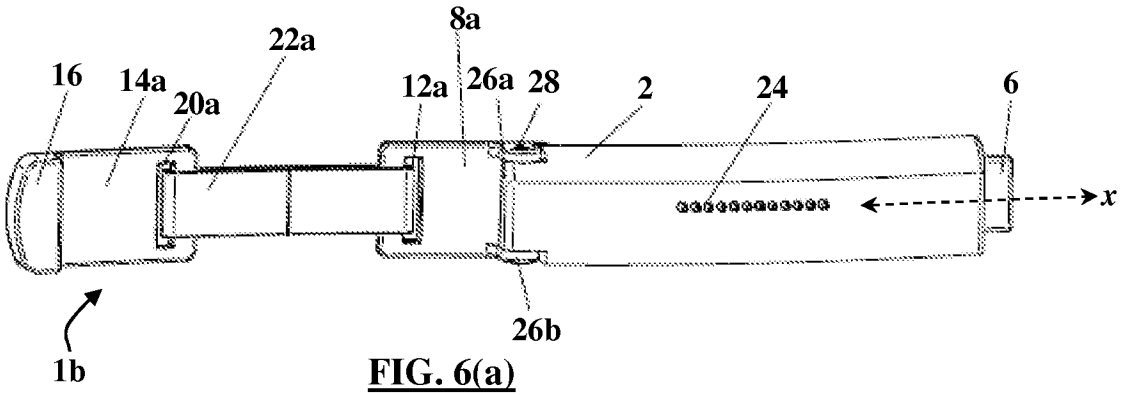
FIG. 6(*a*) is a front perspective view of the hair apparatus of FIG. 4(*c*) in an open configuration and without a cover or teeth according to an embodiment herein.
Figure 6B:
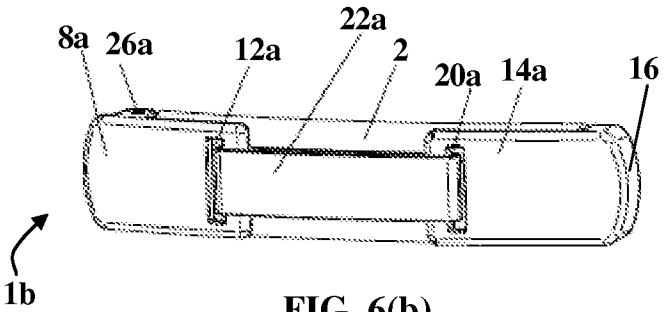
Figure 8C:
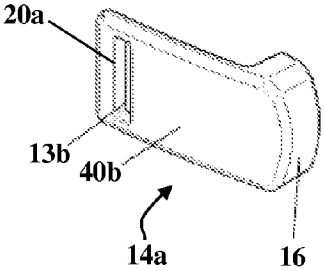
FIG. 8(*a*) is a perspective view of the second clip portion of the hair apparatus of FIGS. 1(*a*) through 6(*b*) according to an embodiment herein.
Figure 8B:
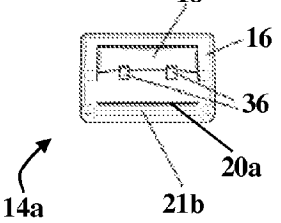
Figure 8A:
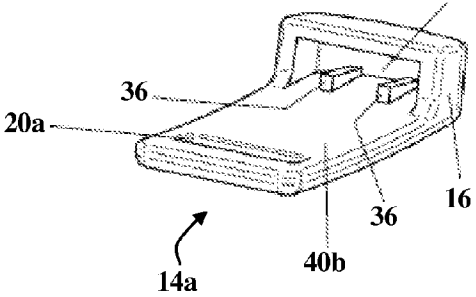

FIG. 6(*a*), with reference to FIGS. 1(*a*) through 5(*c*), is a front perspective view of the hair apparatus 1*b* of FIG. 4(*c*) in an open configuration and without the cover 30 or teeth 34 of the embodiments shown in FIGS. 1(*a*) through 3(*b*) according to an embodiment herein. FIG. 6(*b*), with reference to FIGS. 1(*a*) through 6(*a*), is a front perspective view of the hair apparatus 1*b* of FIG. 5(*c*) in a closed configuration and without the cover 30 or teeth 34 of the embodiments shown in FIGS. 1(*a*) through 3(*b*) according to an embodiment herein. Again, the structure and operation of the hair apparatus 1*b* is similar as that described above with respect to hair apparatus 1*a* except there is no teeth 34 and no cover 30. The views shown in FIGS. 6(*a*) and 6(*b*) further illustrate the general configuration of the flexible member 22*a* in greater detail. As noted above, the flexible member 22*a* may be configured as a generally rectangular band, although other shapes are possible, and the embodiments herein are not restricted to a particular configuration or geometry of the flexible member 22*a*. The flexible member 22*a* may comprise a single band or multiple bands fastened to one another (e.g., woven, sewn, stitched, etc.). The hair apparatus 1*b* may be configured without the cover 30 accordingly as indicated in FIGS. 6(*a*) and 6(*b*) and its method of operation is similar to the operation described above with reference to the embodiment shown with the cover 30 (e.g., FIGS. 4(*a*) through 5(*c*)) and to the operation described above with reference to hair apparatus 1*a* shown in FIGS. 3(*a*) and 3(*b*).

FIGS. 7(*a*) and 7(*b*), with reference to FIGS. 1(*a*) through 6(*b*), are various views of the first clip portion 8*a* of the hair apparatus 1*a*, 1*b* of FIGS. 1(*a*) through 6(*b*) according to an embodiment herein. The first clip portion 8*a* is used in accordance with hair apparatus 1*a* and 1*b*. In FIG. 7(*a*), the pin 28 is shown as a separately configured structure from the first clip portion 8*a*. The dotted lines between the pin 28 and the holes 27*a*, 27*b* of the pair of eye sockets 26*a*, 26*b*, respectively, illustrate the position on the pin 28 once it is aligned with the holes 27*a*, 27*b*. The first connecting mechanism 10, which comprises the pin 28 and the pair of eye sockets 26*a*, 26*b* having holes 27*a*, 27*b*, respectively, are aligned with the hole 4 (shown in FIGS. 1(*c*) and 4(*c*)) of the spine 2. Preferably, the first clip portion 8*a* is manufactured with the pin 28 being aligned and disposed through the hole 4 of the spine 2 and the holes 27*a*, 27*b* of the pair of eye sockets 26*a*, 26*b* of the first connecting mechanism 10 prior to packaging and shipping. The pin 28, eye sockets 26*a*, 26*b*, and holes 4, 27*a*, 27*b* collectively create a hinge that causes the first connecting mechanism 10 to rotate with respect to the spine 2, which thereby causes the first clip portion 8*a* to rotate with respect to the spine 2. In this regard, the first clip portion 8*a* is not integrally attached to the spine 2. The first aperture 13*a* of the first clip portion 8*a* allows the flexible member 22*a* (of FIGS. 1(*a*) through 6(*b*)) to pass therethrough and become secured to the first attachment mechanism 12*a*, which in the embodiment shown in FIGS. 1(*a*) through 7(*b*) constitutes the second end 11*b* of the first clip portion 8*a* together with the aperture 13*a*.

FIGS. 8(*a*) through 8(*e*), with reference to FIGS. 1(*a*) through 7(*b*), are various views of the second clip portion 14*a* of the hair apparatus 1*a*, 1*b* of FIGS. 1(*a*) through 6(*b*) according to an embodiment herein. The at least one stopper 36 positioned in the catch 18 may be configured as a pair of substantially elongated shaped wedges, although other shapes and other configurations are possible, and the embodiments herein are not limited to a particular shape, configuration, or number of stoppers 36. Preferably, the at least one stopper 36 allows the peg 6 of the spine 2 (of FIGS. 1(*a*) through 6(*b*)) to rest securely in the catch 18 with little movement or "play" of the peg 6. Again, the second clip portion 14*a* is pulled over the peg 6 with the flexible member 22*a* (of FIGS. 1(*a*) through 6(*b*)) providing resistance to the attached second clip portion 14*a* to prevent the second clip portion 14*a* from loosely detaching from the hair apparatus 1*a*, 1*b*. Once the peg 6 is seated in the catch 18 of the second clip portion 14*a*, the flexible member 22*a* continues to provide resistance to the second clip portion 14*a* to prevent the second clip portion 14*a* from releasing the peg 6 and detaching from the spine 2. In this regard, the second clip portion 14*a* is not integrally attached to the spine 2. The second aperture 13*b* of the second clip portion 14*a* allows the flexible member 22*a* (of FIGS. 1(*a*) through 6(*b*)) to pass therethrough and become secured to the second attachment mechanism 20*a*, which in the embodiment shown in FIGS. 1(*a*) through 6(*b*) and 8(*a*) through 8(*e*) constitutes the second end 21*b* of the second clip portion 14*a* together with the aperture 13*b*.

During operation of the hair apparatus 1*a*, 1*c*, the user (not shown) may lift and twist his/her hair (not shown), and the teeth 34 is inserted in the user's hair (not shown) behind the lifted and twisted portion of the user's hair (not shown). After the second clip portion 14*a*, 14*b* is attached to the peg 6 of the spine 2, the user lets the hair (not shown) drop over the hair apparatus 1*a*, 1*c*.

FIGS. 9(*a*) through 9(*d*), with reference to FIGS. 1(*a*) through 8(*e*), are various views of the cover 30 of the hair apparatus 1*a*, 1*b* of FIGS. 1(*a*) through 2(*f*) and 4(*a*) through 5(*c*) according to an embodiment herein. Again, the cover 30 may or may not be included with the hair apparatus 1*a*, 1*b*, and the cover 30 may comprise decorative features 37 such as markings, cuts, designs, colors, etc., which can be further seen in FIG. 2(*f*). Additionally, the cover 30 may be flexible, curvilinear in shape (although other shapes and configurations are possible) and may comprise of any of plastic, metal, rubber, cloth, and nylon, as well as other suitable materials.

FIGS. 10(*a*) through 10(*c*), with reference to FIGS. 1(*a*) through 9(*d*), are various views of a hair apparatus 1*c* in a closed configuration according to another embodiment herein. In FIGS. 10(*a*) through 10(*c*), the hair apparatus 1*c* is depicted comprising a generally elongated spine 2 comprising a substantially longitudinal axis x. The spine 2 is slightly curvilinear or arc-shaped, therefore for the purposes of the descriptions of the embodiments herein, the longitudinal axis x is considered to follow the general curvilinearity of the spine 2. The spine 2 comprises a hole (not shown in FIGS. 10(*a*) through 10(*c*)), and similarly configured to the hole 4 shown in phantom lines in FIGS. 1(*c*) and 4(*c*) with respect to hair apparatus 1*a*, 1*b*, respectively. The spine 2 also comprises a peg (not shown in FIGS. 10(*a*) through 10(*c*)), and similarly configured to the peg 6 that outwardly protrudes from the edge 7 of the spine 2 and along the longitudinal axis x of the spine 2 as depicted in FIGS. 1(*a*) through 6(*b*) with respect to hair apparatus 1*a*, 1*b*, whereby the peg 6 may be substantially elongated in shape and have a thickness less than the thickness of the spine 2. The spine 2 comprises a plurality of protrusions 24 outwardly projecting orthogonal to the longitudinal axis x of the spine 2. In this regard, the protrusions 24 are aligned in a substantially linear manner (although following the general curvilinear shaped of the spine 2) along the spine 2 and project outward away from the spine 2 in a direction that is substantially perpendicular to the longitudinal axis x of the spine 2. The hair apparatus 1*c* further includes a first clip portion 8*b* comprising a first connecting mechanism 10 that non-integrally connects the first clip portion 8*b* with the spine 2. In FIG. 13(*a*), the first connecting mechanism 10 is depicted as the portion of the first clip portion 8*b* defined by the dashed encircled area.

Accordingly, the first connecting mechanism 10 comprises a pin 28 and a pair of eye sockets 26*a*, 26*b* that have holes 27*a*, 27*b*, respectively, that align with the hole (not shown in FIGS. 10(*a*) through 10(*c*) but similarly configured to the hole 4 of hair apparatus 1*a*, 1*b* described above) of the spine 2. Similarly, the pin 28 is aligned and disposed through the hole 4 of the spine 2 and the holes 27*a*, 27*b* of the pair of eye sockets 26*a*, 26*b* of the first connecting mechanism 10, wherein the pin 28 causes the first connecting mechanism 10 to rotate with respect to the spine 2.

The first connecting mechanism 10 is positioned at a first end 11*a* (best shown in FIG. 13(*a*)) of the first clip portion 8*b*. Additionally, the first clip portion 8*b* comprises a first attachment mechanism 12*b* positioned at a second end 11*b* (best shown in FIG. 13(*a*)) of the first clip portion 8*b*, wherein the first end 11*b* (best shown in FIG. 13(*a*)) is at an opposite end from the second end 11*b* (best shown in FIG. 13(*a*)), and thereby the first connecting mechanism 10 and the first attachment mechanism 12*b* are positioned at opposite ends 11*a*, 11*b*, respectively, of the first clip portion 8*b* (best shown in FIG. 13(*a*)).

The hair apparatus 1*c* also comprises a second clip portion 14*b* comprising a second connecting mechanism 16 comprising a catch (not shown in FIGS. 10(*a*) through 10(*c*), but similarly configured to the catch 18 of FIGS. 8(*a*) and 8(*b*) with respect to hair apparatus 1*a*, 1*b*) that receives the peg 6 of the spine 2, wherein the second connecting mechanism 16 is positioned at a first end 21*b* (best shown in FIG. 13(*b*)) of the second clip portion 14*b*. Similarly, the catch 18 comprises at least one stopper 36 that engages the peg 6 to prevent dislodgement of the peg 6 once the peg 6 is seated in the catch 18 (similar to the configuration shown in FIGS. 8(*a*) through 8(*e*) with respect to hair apparatus 1*a*, 1*b*).

Moreover, the second clip portion 14*b* also comprises a second attachment mechanism 20*b* positioned at a second end 21*b* (best shown in FIG. 13(*b*)) of the second clip portion 14*b*, wherein the first end 21*a* (best shown in FIG. 13(*b*)) is at an opposite end from the second end 21*b* (best shown in FIG. 13(*b*)), and thereby the second connecting mechanism 16 and the second attachment mechanism 20*b* are positioned at opposite ends 21*a*, 21*b*, respectively, of the second clip portion 14*b*, respectively (best shown in FIG. 13(*b*)).

The hair apparatus 1*c* further comprises a flexible member 22*b* operatively and slidably connected to each of the first clip portion 8*b* and the second clip portion 14*b*. The flexible member 22*b* is stretchable and may be embodied as an elastic or flexible band, wherein the elasticity of the flexible member 22*b* is mechanically structured to permit the second clip portion 14*b* to engage the peg 6 of the spine 2. Moreover, the elasticity of the flexible member 22*b* is mechanically structured to pull and retain the second clip portion 14*b* towards the spine 2 upon the peg 6 being seated in the catch 18. The flexible member 22*b* may comprise decorative features 37 such as markings, cuts, designs, colors, etc. Additionally, the flexible member 22*b* may be bendable, stretchable, and curvilinear in shape (although other shapes and configurations are possible) and may comprise of any of rubber, cloth, and nylon, as well as other suitable materials. The flexible member 22*b* comprises a first bar 38*a* that engages the first attachment mechanism 12*b* of the first clip portion 8*b*. Additionally, the flexible member 22*b* comprises a second bar 38*b* that engages the second attachment mechanism 20*b* of the second clip portion 14*b*.

The hair apparatus 1*c* further comprises a plurality of teeth 34 coupled to the spine 2, wherein the teeth 34 comprise a curved and tapered configuration 35 to facilitate proper seating in the user's hair (not shown) and to prevent unintended discharge of the hair apparatus 1*c* once positioned in the user's hair (not shown). The teeth 34 are integrally formed with the spine 2 to create a single fixed structure of the teeth 24 and spine 2.

The first attachment mechanism 12*b* is substantially elongated and outwardly protrudes from the elongated section 42*a* of the first clip portion 8*b* (best shown in FIG. 13(*a*)). The elongated section 42*a* of the first clip portion 8*b* is permitted to slide with respect to the first bar 38*a* of the flexible member 22*b* until the first bar 38*a* reaches the eye sockets 26*a*, 26*b* of the first clip portion 8*b* or until the first bar 38*a* reaches the first attachment mechanism 12*b*, thus preventing the flexible member 22*b* from dislodging from the first clip portion 8*b*. The first bar 38*a* is also comprised of flexible material to allow the first bar 38*a* to stretch over the first attachment mechanism 12*b* and to become slidably attached to the first clip portion 8*b*. However, the flexible material of the first bar 38*a* reverts back to its original pre-stretched configuration to retain the flexible member 22*b* within the slidable limits imposed by the distance between the first attachment mechanism 12*b* and the eye sockets 26*a*, 226*b*.

The second attachment mechanism 20*b* is also substantially elongated and outwardly protrudes from the elongated section 42*b* of the second clip portion 14*b* (best shown in FIG.

13(*b*)). The elongated section 42*b* of the second clip portion 14*b* is permitted to slide with respect to the second bar 38*b* of the flexible member 22*b* until the second bar 38*b* reaches the second connecting mechanism 16 of the second clip portion 14*b* or until the second bar 38*b* reaches the second attachment mechanism 20*b*, thus preventing the flexible member 22*b* from dislodging from the second clip portion 14*b*. The second bar 38*b* is also comprised of flexible material to allow the second bar 38*b* to stretch over the second attachment mechanism 20*b* and to become slidably attached to the second clip portion 14*b*. However, the flexible material of the second bar 38*b* reverts back to its original pre-stretched configuration to retain the flexible member 22*b* within the slidable limits imposed by the distance between the second attachment mechanism 20*b* and the second connecting mechanism 16.

When in operation, the teeth 34 are inserted in the user's hair (not shown) and then a portion of the user's hair (not shown) is gathered and placed on the spine 2 and substantially over the plurality of protrusions 24 when the hair apparatus 1*c* is in an open configuration. Next, the first clip portion 8*b* is rotatably closed to compress the gathered hair (not shown) between the spine 2 and the back of the flexible member 22*b* and potentially a portion of the back of the first clip portion 8*b*. Then, the second clip portion 14*b* is pulled over the peg 6 with the flexible member 22*b* providing resistance to the attached second clip portion 14*b* to prevent the second clip portion 14*b* from loosely detaching from the hair apparatus 1*c*. Once the peg 6 is seated in the catch 18 of the second clip portion 14*b*, the flexible member 22*b* continues to provide resistance to the second clip portion 14*b* to prevent the second clip portion 14*b* from releasing the peg 6 and detaching from the spine 2. Additionally, as described above, the at least one stopper 36 also engages the peg 6 to prevent dislodgement of the peg 6 once the peg 6 is seated in the catch 18.

FIG. 11, with reference to FIGS. 1(*a*) through 10(*c*), is an elevated front perspective view of the hair apparatus 1*c* of FIG. 10(*a*) without a flexible member 22*b* for illustrative purposes only. FIG. 12, with reference to FIGS. 1(*a*) through 11, is an elevated front perspective view of the flexible member 22*b* of the hair apparatus 1*c* of FIGS. 10(*a*) through 10(*c*) according to another embodiment herein. The flexible member 22*b* may comprise decorative features 37 such as markings, cuts, designs, colors, etc. and may have holes 44 dispersed therethrough.

FIGS. 13(*a*) and 13(*b*), with reference to FIGS. 1(*a*) through 12, is a rear perspective view of the first clip and second clip, respectively of the hair apparatus of FIGS. 10(*a*) through 11 according to another embodiment herein. The first connecting mechanism 10 and the second connecting mechanism 16 shown in FIGS. 13(*a*) and 13(*b*) as it relates to hair apparatus 1*c* work similarly to the first connecting mechanism 10 and the second connecting mechanism 16 shown in FIGS. 1(*a*) through 8(*e*) with respect to hair apparatus 1*a*, 1*b*.

Figure 14:
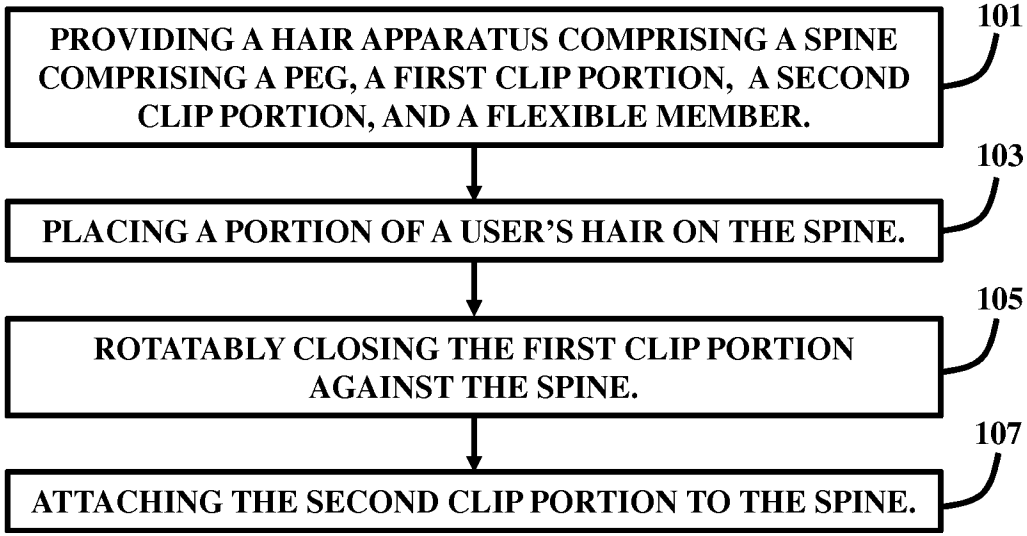
FIG. 14 is a flow diagram illustrating a method according to an embodiment herein.

FIG. 14, with reference to FIGS. 1(*a*) through 13, is a flow diagram illustrating a hair retention method according to an embodiment herein, wherein the method comprises providing (101) a hair apparatus 1*a*, 1*b*, 1*c* comprising a spine 2 comprising a peg 6 outwardly protruding from an edge 7 of the spine 2 and substantially along a longitudinal axis x of the spine 2; a first clip portion 8*a*, 8*b* rotatably connecting the first clip portion 8*a*, 8*b* with the spine 2; a second clip portion 14*a*, 14*b* detachably connected to the spine 2; and a flexible member 22*a*, 22*b* operatively connected to each of the first clip portion 8*a*, 8*b* and the second clip portion 14*a*, 14*b*. The method further comprises placing (103) a portion of a user's hair (not shown) on the spine 2; rotatably closing (105) the first clip portion 8*a*, 8*b* against the spine 2; and attaching (107) the second clip portion 14*a*, 14*b* to the spine 2, wherein the second clip portion 14*a*, 14*b* comprises a catch 18 that receives the peg 6 of the spine 2, and wherein attachment of the second clip portion 14*a*, 14*b* to the spine 2 causes retention of the hair (not shown) between the spine 2 and the flexible member 22*a*, 22*b*.

The flexible member 22*a*, 22*b* is stretchable, wherein an elasticity of the flexible member 22*a*, 22*b* is mechanically structured to permit the second clip portion 14*a*, 14*b* to engage the peg 6, and wherein the elasticity of the flexible member 22*a*, 22*b* is mechanically structured to pull and retain the second clip portion 14*a*, 14*b* towards the spine 2 upon the peg 6 being seated in the second clip portion 14*a*, 14*b*.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A hair apparatus comprising:

a comb portion comprising:

a spine comprising a longitudinal axis, wherein said spine comprises:

a first end comprising a hole; and a second end oppositely positioned from said first end, wherein said second end comprises a peg outwardly protruding substantially along said longitudinal axis of said spine, wherein said peg comprises a length, width, and height different than a length, width, and height of said spine; and a plurality of teeth coupled to said spine;

a first clip portion coupled to said spine, wherein said first clip portion comprises:

a rotation mechanism that rotatably and non-integrally connects said first clip portion with said first end of said spine, wherein said rotation mechanism comprises a pair of sockets that align with said hole of said first end of said spine; and a first aperture positioned at an opposite end from said rotation mechanism;

a second clip portion coupled to said spine, wherein said second clip portion comprises:

an attachment mechanism comprising a catch that receives said peg of said second end of said spine, wherein said catch comprises at least one stopper that engages said peg to prevent dislodgement of said peg once seated in said catch; and a second aperture positioned at an opposite end from said attachment mechanism;

a stretchable band positioned through each of said first aperture and said second aperture; and a cover comprising at least one bar, wherein said stretchable band is positioned through said at least one bar to operatively connect said cover to said stretchable band.

2. The hair apparatus of claim 1, wherein said spine comprises a plurality of protrusions outwardly projecting orthogonal to said longitudinal axis of said spine.

3. The hair apparatus of claim 1, further comprising a pin aligned and disposed through said hole of said first end of said spine and said pair of sockets of said rotation mechanism of said first clip portion.

4. The hair apparatus of claim 1, wherein an elasticity of said stretchable band is mechanically structured to permit said second clip portion to engage said peg.

5. The hair apparatus of claim 4, wherein said elasticity of said stretchable band is mechanically structured to pull and retain said second clip portion towards said spine upon said peg being seated in said catch.

6. The hair apparatus of claim 1, wherein said cover comprises:

a curved surface; and tips that are adjacent to each of said first clip portion and said second clip portion.

7. A hair apparatus comprising:

a spine comprising a hole;

a peg extending from said spine and substantially along a longitudinal axis of said spine, wherein said peg comprises a thickness different than a thickness of said spine;

a first clip portion comprising:

a first connecting mechanism that non-integrally connects said first clip portion with said spine; and a first attachment mechanism positioned at an opposite end from said first connecting mechanism;

a second clip portion comprising:

a second connecting mechanism comprising a catch that receives said peg; and a second attachment mechanism positioned at an opposite end from said second connecting mechanism;

a flexible member operatively connected to any of said first clip portion and said second clip portion; and a cover comprising at least one bar, wherein said flexible member is positioned through said at least one bar.

8. The hair apparatus of claim 7, wherein said spine comprises a plurality of protrusions outwardly projecting orthogonal to said longitudinal axis of said spine.

9. The hair apparatus of claim 7, wherein said first connecting mechanism comprises a pair of sockets that align with said hole of said spine.

10. The hair apparatus of claim 9, further comprising a pin aligned and disposed through said hole of said spine and said pair of sockets of said first connecting mechanism of said first clip portion, wherein said pin causes said first connecting mechanism to rotate with respect to said spine.

11. The hair apparatus of claim 7, wherein said flexible member is stretchable, and wherein an elasticity of said flexible member is mechanically structured to permit said second clip portion to engage said peg.

12. The hair apparatus of claim 11, wherein said elasticity of said flexible member is mechanically structured to pull and retain said second clip portion towards said spine upon said peg being seated in said catch.

13. The hair apparatus of claim 7, wherein said cover is curved, and wherein said cover comprises tips that are adjacent to each of said first clip portion and said second clip portion.

14. The hair apparatus of claim 7, further comprising a plurality of teeth coupled to said spine.

15. The hair apparatus of claim 7, wherein said catch comprises at least one stopper that engages said peg to prevent dislodgement of said peg once seated in said catch.

16. The hair apparatus of claim 7, wherein said flexible member comprises:

a first bar that engages said first attachment mechanism of said first clip portion; and a second bar that engages said second attachment mechanism of said second clip portion.

17. A hair apparatus comprising:

a spine;

a peg outwardly protruding from said spine and substantially along a longitudinal axis of said spine, wherein said peg comprises any of a length, width, and height different than any of a length, width, and height of said spine;

a first clip portion comprising:

a first connecting mechanism that non-integrally connects said first clip portion with said spine; and a first attachment mechanism substantially positioned at an opposite end from said first connecting mechanism;

a second clip portion comprising:

a second connecting mechanism comprising a catch that receives said peg of said spine; and a second attachment mechanism substantially positioned at an opposite end from said second connecting mechanism;

a flexible member operatively connected to any of said first clip portion and said second clip portion, wherein said first attachment mechanism comprises a first aperture, wherein said second attachment mechanism comprises a second aperture, and wherein said flexible member is dimensioned and configured to fit through each of said first aperture and said second aperture.

18. The hair apparatus of claim 17, wherein said flexible member comprises stretchable material, and wherein an elasticity of said flexible member is mechanically structured to permit said second clip portion to engage said peg.

19. The hair apparatus of claim 17, further comprising a plurality of teeth operatively connected to said spine.

20. The hair apparatus of claim 17, wherein said catch comprises at least one stopper configured to engage said peg.

* * * * *